US007456369B2

(12) United States Patent
Watanabe

(10) Patent No.: US 7,456,369 B2
(45) Date of Patent: Nov. 25, 2008

(54) PUSH BUTTON MECHANISM, OPERATION PANEL, AND IMAGE FORMING APPARATUS

(75) Inventor: Hayato Watanabe, Hiratuka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/492,827

(22) Filed: Jul. 26, 2006

(65) Prior Publication Data

US 2007/0023270 A1 Feb. 1, 2007

(30) Foreign Application Priority Data

Jul. 27, 2005 (JP) ..... 2005-216593

(51) Int. Cl.
*H01H 3/12* (2006.01)
*H01H 13/14* (2006.01)

(52) U.S. Cl. ..... 200/341; 200/520

(58) Field of Classification Search ..... 200/341
See application file for complete search history.

(56) References Cited

U.S. PATENT DOCUMENTS 4,638,151 A * 1/1987 Suwa ..... 235/145 R
4,689,455 A * 8/1987 Watanabe ..... 200/534
6,031,196 A * 2/2000 Johnston ..... 200/343
6,494,615 B2 * 12/2002 Wyssbrod ..... 368/319
6,576,856 B2 * 6/2003 Masaru et al. ..... 200/512
6,770,824 B1 * 8/2004 Faucher ..... 200/5 A

FOREIGN PATENT DOCUMENTS

JP 07-085751 3/1995

* cited by examiner

*Primary Examiner*—Elvin G Enad
*Assistant Examiner*—Lheiren Mae A Anglo
(74) *Attorney, Agent, or Firm*—Oblon, Spivak, McClelland, Maier & Neustadt, P.C.

(57) ABSTRACT

A push button mechanism that includes plural push button members and one or more positioning members. The plural push button members have push portions for receiving an external force. The positioning member includes plural positioning portions corresponding to each shape of the plural push button members. The positioning member prevents engaging each corresponding push button member with each positioning portion that does not correspond to the push button member.

16 Claims, 13 Drawing Sheets

PUSH BUTTON MECHANISM, OPERATION PANEL, AND IMAGE FORMING APPARATUS

CROSS-REFERENCE TO RELATED APPLICATIONS

The present application is based on Japanese Patent Application No. 2005-216593, filed Jul. 27, 2005, the entire contents of which are incorporated herein by reference.

BACKGROUND OF THE INVENTION

1. Field of the Invention

The present invention relates to a push button mechanism, an operation panel, and an image forming apparatus. More particularly, the present invention relates to a push button mechanism having push button member, an operation panel having a push button mechanism, and an image forming apparatus including the operation panel.

2. Discussion of the Background

Conventionally, an image forming apparatus such, as a copier or a printer, has an operation panel for inputting an instruction. The inputting instruction is inputted to the image forming apparatus by using a push button mechanism which has plural key top members. The key top members correspond to the functions or actions which get executed in the image forming apparatus. The names of the functions or actions are indicated on the key top members.

Typically, the key top member has a push portion for receiving an external force. Further, the key top member has flexible claws for engaging the housing's depression of the image forming apparatus. The key top member including the push portion and the flexible claws is integrally produced by injection molding using plastic. The key top member is allowed to slide in a predetermined direction. Japanese Laid-open patent application 1995-85751 discloses such key top members.

However, in the above mentioned key top members, it is possible that the key top members are attached to a wrong portion, e.g., when the key top member is attached to the housing of an image forming apparatus.

Furthermore, demand for the multi-function peripheral (MFP) as an image forming apparatus performing plural functions that are, for instance, a copier function, a printer function, and a facsimile function is expected to increase.

Therefore, an interface of such an imaging forming apparatus tends to have a lot of key top members.

SUMMARY OF THE INVENTION

The present invention was made in consideration of the above-mentioned problems, and it is an object of the present invention to solve these problems.

It is another object of the present invention to provide a push button mechanism preventing the key top (push button) members from attachment to a wrong portion.

It is still another object of the invention to provide an operation panel and an image forming apparatus that can reduce production cost.

According to a first aspect of the present invention, a push button mechanism includes plural push button members having push portions for receiving an external force, a positioning member having plural positioning portions corresponding to each shape of the plural push button members, which prevents engagement of each key top member with each positioning portion that does not correspond to the push button member.

According to another aspect of the invention, a push button mechanism includes plural push button members having push portions for receiving an external force, a positioning member having plural positioning portions corresponding to each shape of the plural push button members, which prevents engaging the each push button member with each positioning portion which doesn't correspond, wherein each plural push button member has one or more discriminative projections to one of the push button members, and the positioning member has one or more discriminative holes corresponding to the one or more projections.

According to another aspect of the invention, a push button mechanism includes plural push button members having push portions for receiving an external force, a positioning member having plural positioning portions corresponding to each shape of the plural push button members, which prevents engaging each push button member with each positioning portion which doesn't correspond, wherein each the plural push button member has a pair of discriminative projections located in asymmetric portions to the center of the push portions, then said positioning member has one or more discriminative holes corresponding to the one or more projections.

According to another aspect of the invention, the push button mechanism further includes elastic members corresponding to the plural push button members, and each push button member is biased to an opposite direction of the external force's direction.

According to another aspect of the invention, the push button member has engaging members for engaging to said positioning member.

According to another aspect of the invention, the engaging members located in both edges of said push portion, thereby, the engaging members located in one edge become a pivot when the external force acts upon a portion which is not center of the push portion.

According to another aspect of the invention, an operation panel use the above mentioned push button mechanism.

According to another aspect of the invention, an image forming apparatus use the above mentioned operation panel.

BRIEF DESCRIPTION OF THE DRAWINGS

A more complete appreciation of the present invention and the many attendant advantages thereof will be readily obtained as the same becomes better understood by reference to the following detailed description, when considered in connection with the accompanying drawings, wherein.

DESCRIPTION OF THE PREFERRED EMBODIMENTS

Figure 1:
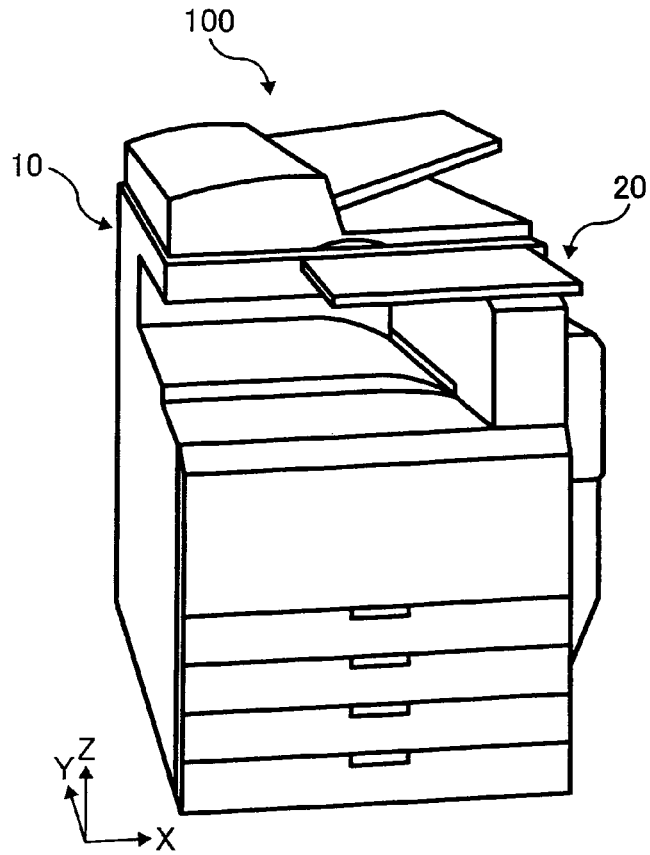
FIG. 1 illustrates a copier in an embodiment according to the present invention.

Referring now to the drawings, wherein like reference numerals designate identical or corresponding parts throughout the several views, and more particularly to FIG. 1 thereof, there is illustrated an appearance of a copier 100 as the above-mentioned image forming apparatus.

The copier 100 includes an operation panel 20 and a main body 10. The operation panel 20 is fixed in the upper end of the front (Y-side in FIG. 1) of the main body 10. The main body 10 reads a document and records an image on paper based on the document.

The main body 10 includes a scanner device, a photo-sensitive body, a light scanning device, a developing unit, a transfer device, a fixing unit, a communication device, and a control unit. The scanner device reads image information of a manuscript. The image information is transferred to the light scanning device functioning as a light-exposing mechanism. The light scanning device exposes a surface of the photo-sensitive body according to the image information for the purpose of making a latent image. The latent image on the photo-sensitive body is developed using toner by the developing unit to change the latent image into a tangible image. The tangible image on the photo-sensitive body is then transferred to a paper sheet by the transfer device. Then, the tangible image on the paper sheet is fixed by the fixing unit. The communication device receives input signals from the operation panel 20. The control unit controls each of the units or devices in the main body 10 according to instructions that are included in the input signal from the operation panel 20. In addition, an automatic document feeder (ADF) can be used for the automatic feeding of manuscripts. Therefore the main body 10 further includes the ADF.

Figure 2:
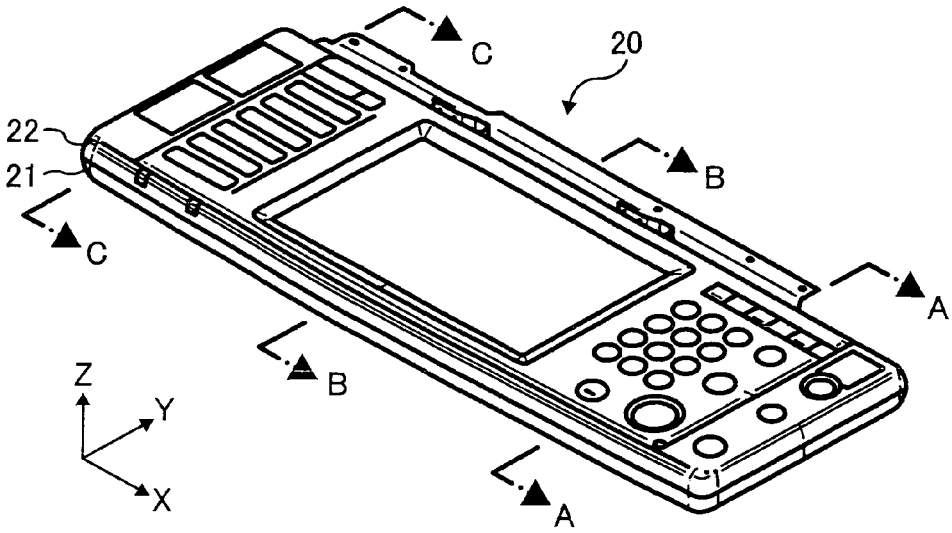
FIG. 2 is a perspective view showing the operation panel of the copier shown in FIG. 1.

As shown in FIG. 2, the operation panel 20 includes a housing having a cover (the upper cover) 22 and a base (a lower cover) 21. The cover 22 and the base 21 are engaged mutually. The housing includes boards 61 and 62, a display unit 50, and other parts (see FIG. 9) in its internal space.

Figure 3A:
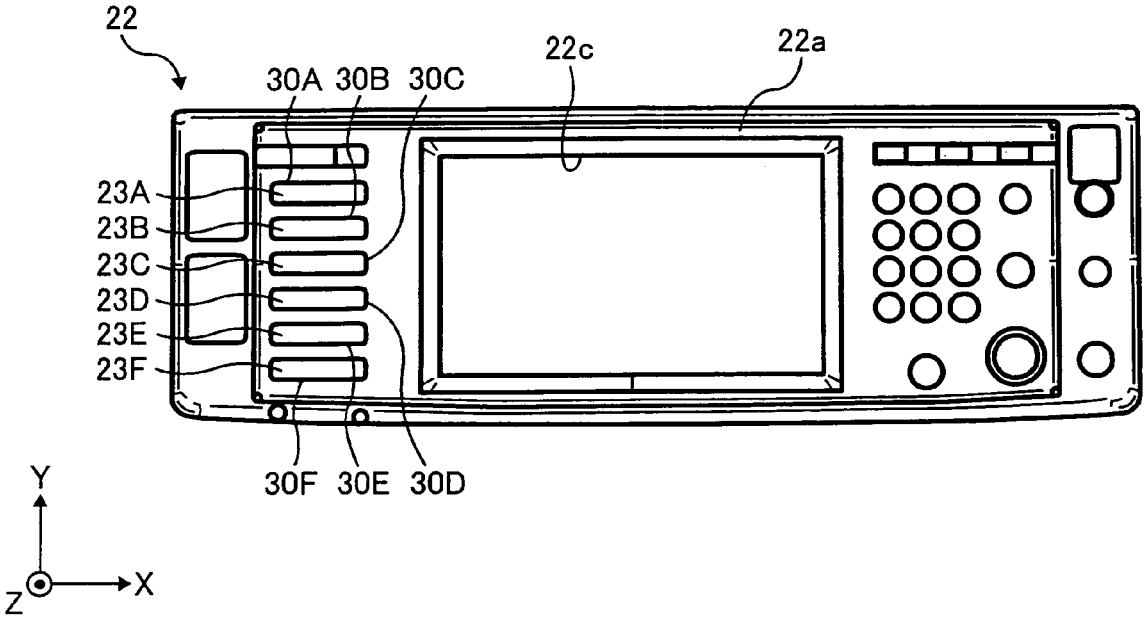
FIG. 3A is a plane view showing a cover of the operation panel shown in FIG. 2.
Figure 3B:
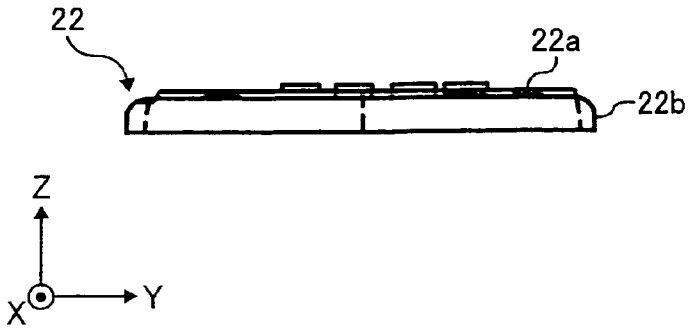
FIG. 3B is a side elevation showing a cover of the operation panel shown in FIG. 2.

As shown in FIG. 3A and FIG. 3B, the cover 22 includes a top board 22*a* and a side wall 22*b*. The top board 22*a* is substantially rectangular and has a longitudinal direction along an X axis direction. The side wall 22*b* is formed on the edge of the top board 22*a*. The cover 22 has a U shape at the YZ section. As shown in FIG. 3A, in the center of top board 22*a*, there is an aperture 22*c* having a longitudinal direction along the X axis direction. In the opposite direction in the X axis direction from the aperture 22*c*, there is a first interface part 28 having plural rectangular apertures that are used to insert plural push buttons for selecting functions of copier 100. A second interface part 29 having plural circular apertures that are used to insert plural push buttons for a numeric keypad or other function is also provided. The cover 22 can be formed, for example, by injection molding, if it is made of plastic.

There are plural circular holes in the X direction from the aperture 22*c*. The circular holes are used to insert push buttons, e.g., ten keys. In an opposite direction in the Z direction from the aperture 22*c*, there are six depressions 23A-23F in the top board 22*a* at regular intervals from the edge in the Y direction to the opposite edge in the Y direction. Each depression 23A-23F has a longitudinal direction along the X direction. And each depression 23A-23F is engaged with the key top (push button) members 30A-30F.

Figure 4:
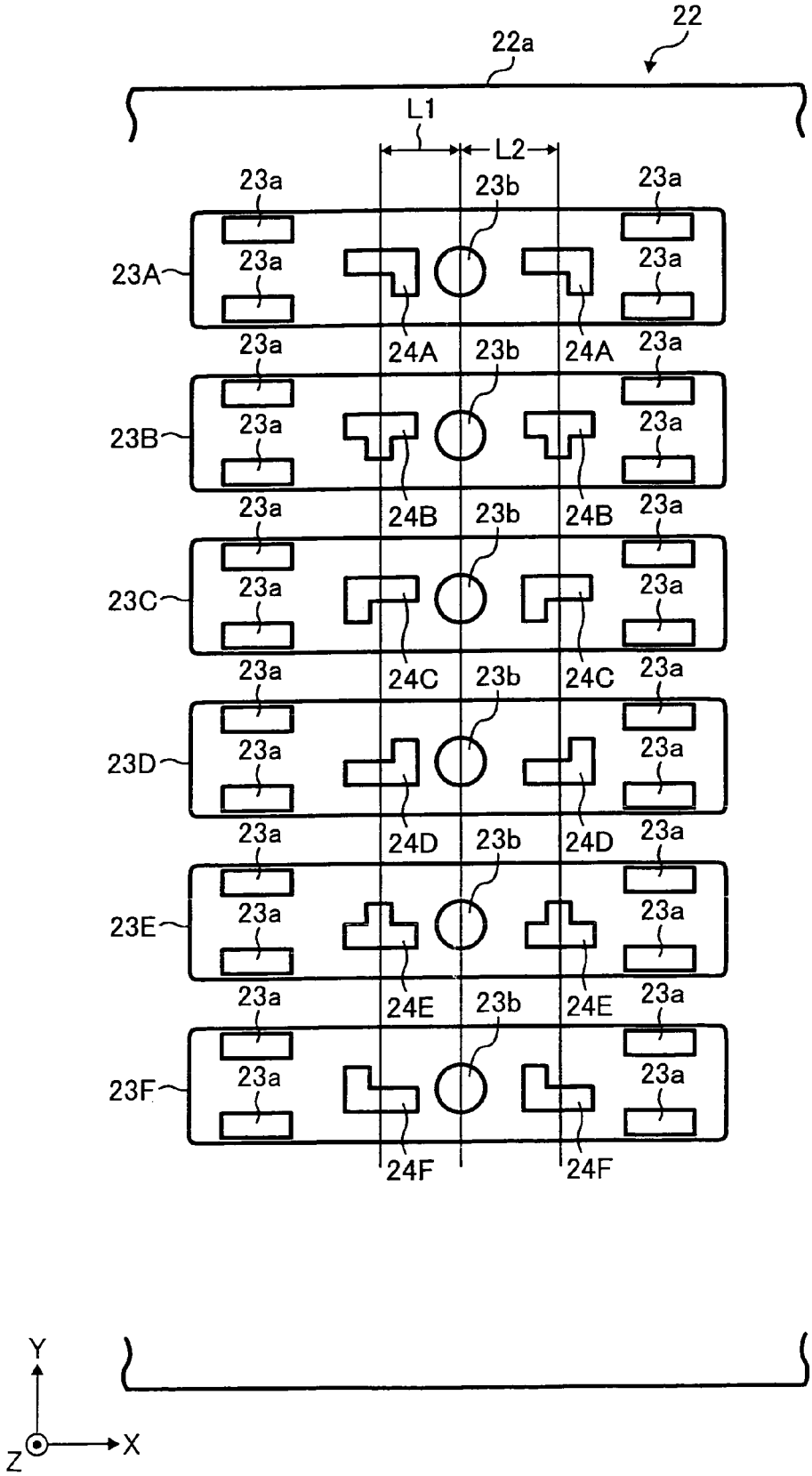
FIG. 4 is a plane view showing plural depressions formed on a cover in the above-mentioned embodiment.

FIG. 4 shows six depressions (first depression 23A, second depression 23B, third depression 23C, fourth depression 23D, fifth depression 23E, and sixth depression 23F) that are located in the top board 22*a* of the cover 22.

As shown in FIG. 4, at the area of four corners in an internal bottom face of the first depression 23A, four rectangular apertures 23*a* having longitudinal directions along an X direction are formed. There is a circular hole 23*b* in an area of the center of the internal bottom face. In an area of the opposite direction of the X direction from the circular hole 23*b*, an L-shaped aperture 24A is formed. The L-shaped aperture 24A has a long side along the X direction, and the corner portion is located at a distance of L1 from the center of the circular hole 23*b*. The L-shaped aperture 24A is formed so that the corner portion is located in the X direction and the Y direction. Furthermore, in an area in the X direction from the circular hole 23*b*, another L-shaped aperture 24A is formed. The L-shaped aperture 24A has a long side along the X direction, and the corner portion is located at a distance of L 2 (L2 is longer than L1) from the center of the circular hole 23*b*. And the L-shaped aperture 24A is formed so that the corner portion is located in the X direction and the Y direction.

At the area of four corners in an internal bottom face of the second depression 23B, four rectangular apertures 23*a* having longitudinal directions along an X direction are formed. There is a circular hole 23*b* in an area of the center of the internal bottom face. In an area of the opposite direction of the X direction from the circular hole 23*b*, a T-shaped aperture 24B is formed. The T-shaped aperture 24B has a leg pointing to the opposite direction in the Y direction, and the center line of the leg is located at a distance of L1 from the center of the circular hole 23*b*. In an area in the X direction from the circular hole 23*b*, another T-shaped aperture 24B is formed. The T-shaped aperture 24B has a leg pointing to the opposite direction in the Y direction, and the centerline of the leg is located at a distance of L2 (L2 is longer than L1) from the center of the circular hole 23*b*.

At the area of four corners in an internal bottom face of the third depression 23C, four rectangular apertures 23*a* having longitudinal directions along an X direction are formed. There is a circular hole 23*b* in an area of the center of the internal bottom face. In an area of the opposite direction of the X direction from the circular hole 23*b*, an L-shaped aperture 24C is formed. The L-shaped aperture 24C has a long side along the X direction, and the corner portion is located at a distance of L1 from the center of the circular hole 23*b*. The L-shaped aperture 24C is formed so that the corner portion is located in the opposite direction in the X direction and the Y direction. Furthermore, in an area in the X direction from the circular hole 23*b*, another L-shaped aperture 24C is formed. The L-shaped aperture 24C has a long side along the X direction, and the corner portion is located at a distance of L2 (L2 is longer than L1) from the center of the circular hole 23*b*. The L-shaped aperture 24C is formed so that the corner portion is located in the opposite direction in the X direction and the Y direction.

At the area of four corners in an internal bottom face of the fourth depression 23D, four rectangular apertures 23*a* having longitudinal directions along an X direction are formed. There is a circular hole 23*b* in an area of the center of the internal bottom face. In an area of the opposite direction of the X direction from the circular hole 23*b*, an L-shaped aperture 24D is formed. The L-shaped aperture 24D has a long side along the X direction, and the corner portion located in a distance of L1 from the center of the circular hole 23*b*. The L-shaped aperture 24D is formed so that the corner portion is located in the X direction and the opposite direction in the Y direction. Furthermore, in an area in the X direction from the circular hole 23*b*, another L-shaped aperture 24D is formed. The L-shaped aperture 24D has a long side along the X direction, and the corner portion is located at a distance of L2 (L2 is longer than L1) from the center of the circular hole 23*b*. The L-shaped aperture 24D is formed so that the corner portion is located in the X direction and the opposite direction in the Y direction.

At the area of four corners in an internal bottom face of the fifth depression 23E, four rectangular apertures 23*a* having longitudinal directions along an X direction are formed. There is a circular hole 23*b* in an area of the center of the internal bottom face. In an area of the opposite direction of the X direction from the circular hole 23*b*, an T-shaped aperture 24E is formed. The T-shaped aperture 24E has a leg pointing to the Y direction, and the centerline of the leg is located at a distance of L1 from the center of the circular hole 23*b*. In an area in the X direction from the circular hole 23*b*, another T-shaped aperture 24E is formed. The T-shaped aperture 24E has a leg pointing to the Y direction, and the center line of the leg located in a distance of L2 (L2 is longer than L1) from the center of the circular hole 23*b*.

At the area of four corners in an internal bottom face of the sixth depression 23F, four rectangular apertures 23*a* having longitudinal directions along an X direction are formed. There is a circular hole 23*b* in an area of the center of the internal bottom face. In an area of the opposite direction of the X direction from the circular hole 23*b*, an L-shaped aperture 24F is formed. The L-shaped aperture 24F has a long side along the X direction, and the corner portion is located at a distance of L1 from the center of the circular hole 23*b*. The L-shaped aperture 24F is formed so that the corner portion is located in the opposite direction in the X direction and the opposite direction in the Y direction. Furthermore, in an area in the X direction from the circular hole 23*b*, another L-shaped aperture 24F is formed. The L-shaped aperture 24F has a long side along the X direction, and the corner portion is located at a distance of L2 (L2 is longer than L1) from the center of the circular hole 23*b*. The L-shaped aperture 24D is formed so that the corner portion is located in the opposite direction in the X direction and the opposite direction in the Y direction.

As above mentioned, each of the L-shaped apertures (24A, 24C, 24D, and 24F), corresponding to each of the depressions (23A, 23C, 23D, and 23F), has a different corner position. Each of the T-shaped apertures (24B and 24E) corresponding to each of the depressions (23B and 23E) has a different leg (T's leg) position. Furthermore, one aperture of a pair of apertures formed in a depression is located at a distance of L1 from a center of a circular hole and the other aperture is located at a distance of L2 from the center of the circular hole. In other words, a pair of the apertures are located in asymmetric portions against the circular hole 23*b*. This is true for each pair of apertures in all the above-mentioned depressions.

Figure 5:
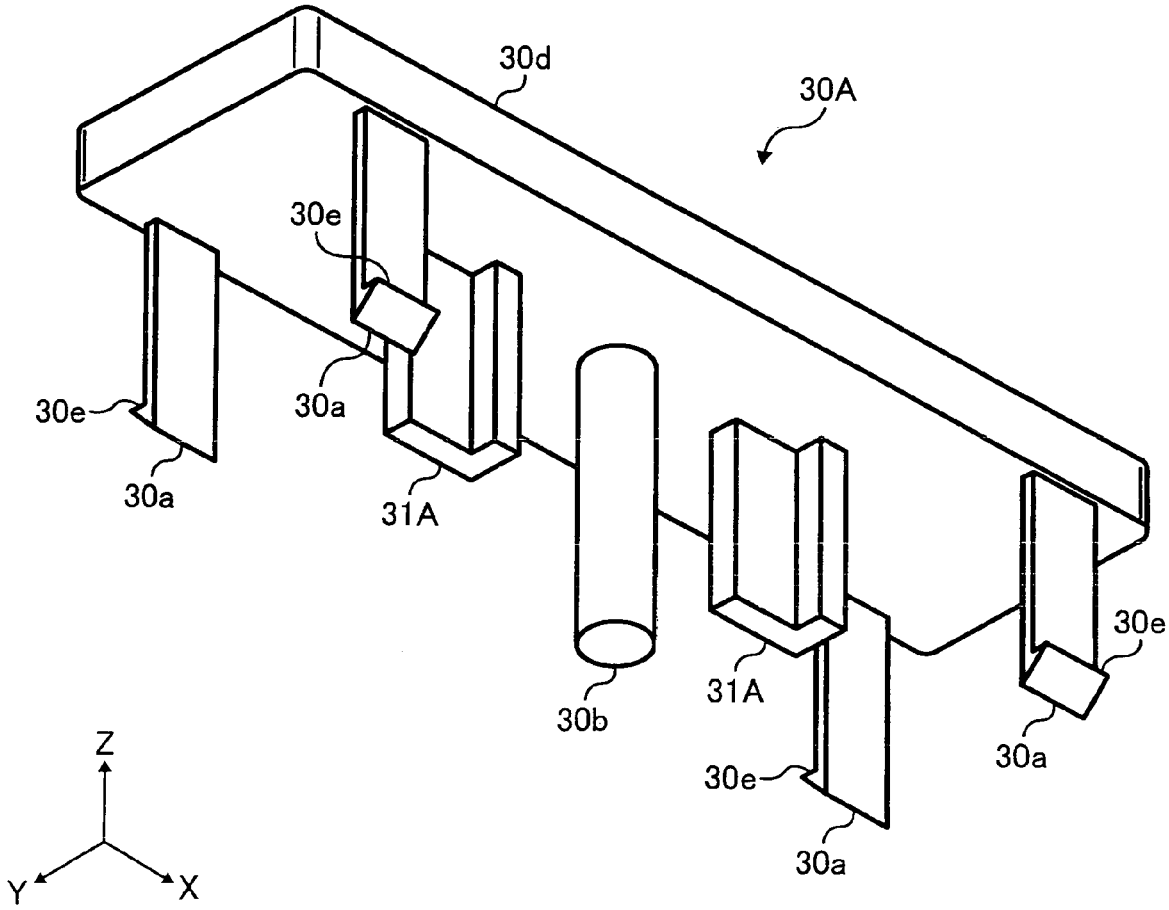
FIG. 5 is a perspective view showing a first key top member engaged to the first depression in FIG. 2.

As shown in FIG. 5, the first key top member 30A includes a push portion 30*d*, four leg portions 30*a*, an actuation portion 30*b*, and a pair of positioning portions 31A.

The push portion 30*d* has a longitudinal direction along the X direction, and is in the shape of a rectangular solid. The four leg portions 30*a* are formed at the four corners on an under surface of the push portion 30*d*. The actuation portion 30*b* is located in the area on the central part of an under surface of the push portion 30*d*. A pair of positioning portions 31A are located along the X direction at both sides of the actuation portion 30*b*.

The first key top member 30A can be formed, for example, by injection molding if it is made of plastic.

Each leg portion 30*a* includes a claw 30*b* turned to the outside of the push portion 30*d*.

A pair of positioning portions 31A are L-shaped in cross-section, and stick out to the under direction from the under surface of the push portion 30*d*. When the first key top member 30A is attached to the first depression 23A, a pair of positioning portions 31A are inserted to a pair of apertures 24A with a predetermined clearance.

Figure 6:
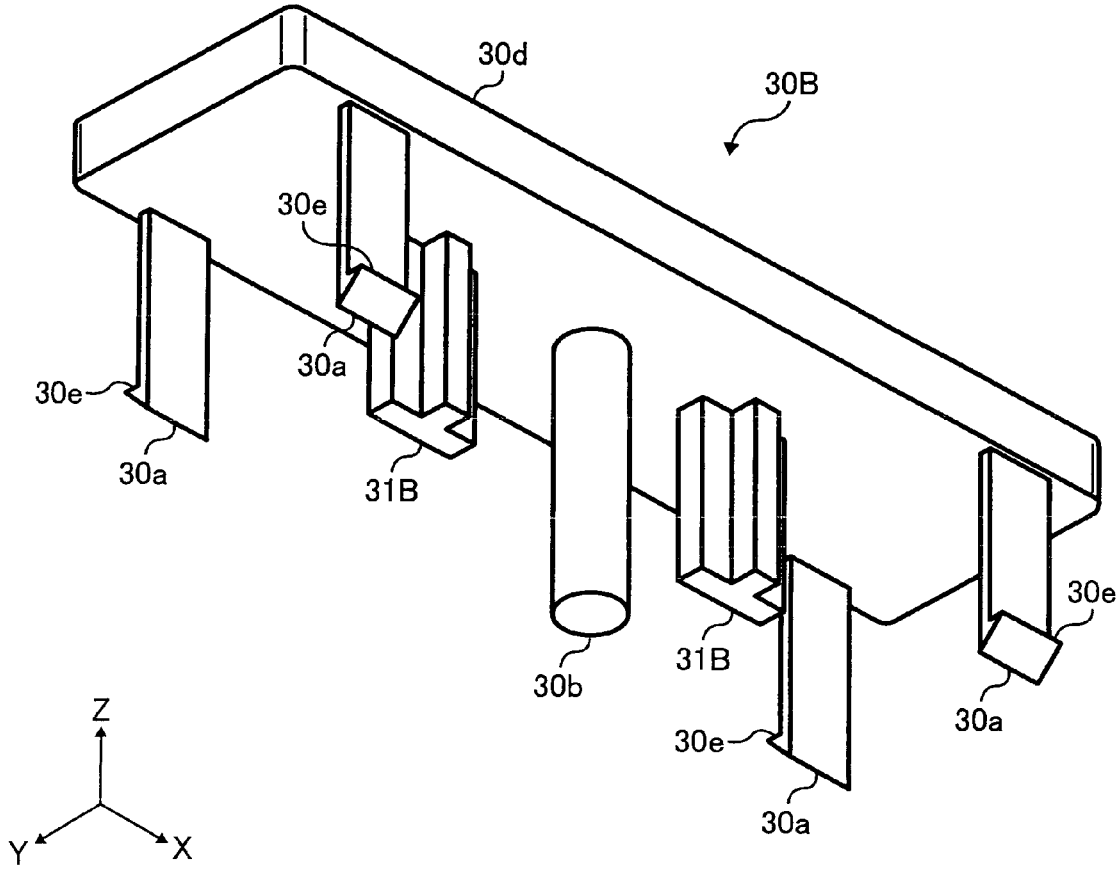
FIG. 6 is a perspective view showing a second key top member engaged with a second depression in FIG. 2.

As shown in FIG. 6, the second key top member 30B includes a push portion 30*d*, four leg portions 30*a*, an actuation portion 30*b*, and a pair of positioning portions 31B.

The push portion 30*d* has a longitudinal direction along the X direction, and is in the shape of a rectangular solid. The four leg portions 30*a* are formed at the four corners on an under surface of the push portion 30*d*. The actuation portion 30*b* is located in the area on the central part of an under surface of the push portion 30*d*. A pair of positioning portions 31B are located along the X direction at both sides of the actuation portion 30*b*.

The second key top member 30B can be formed, for example, by injection molding if it is made of plastic.

Each leg portion 30*a* includes a claw 30*b* turned to the outside of the push portion 30*d*.

A pair of positioning portions 31B are T-shaped in a cross-section, and stick out to the under direction from the under surface of the push portion 30*d*. When the second key top member 30B is attached to the first depression 23B, a pair of positioning portions 31B are inserted to a pair of apertures 24B with a predetermined clearance.

Figure 7:
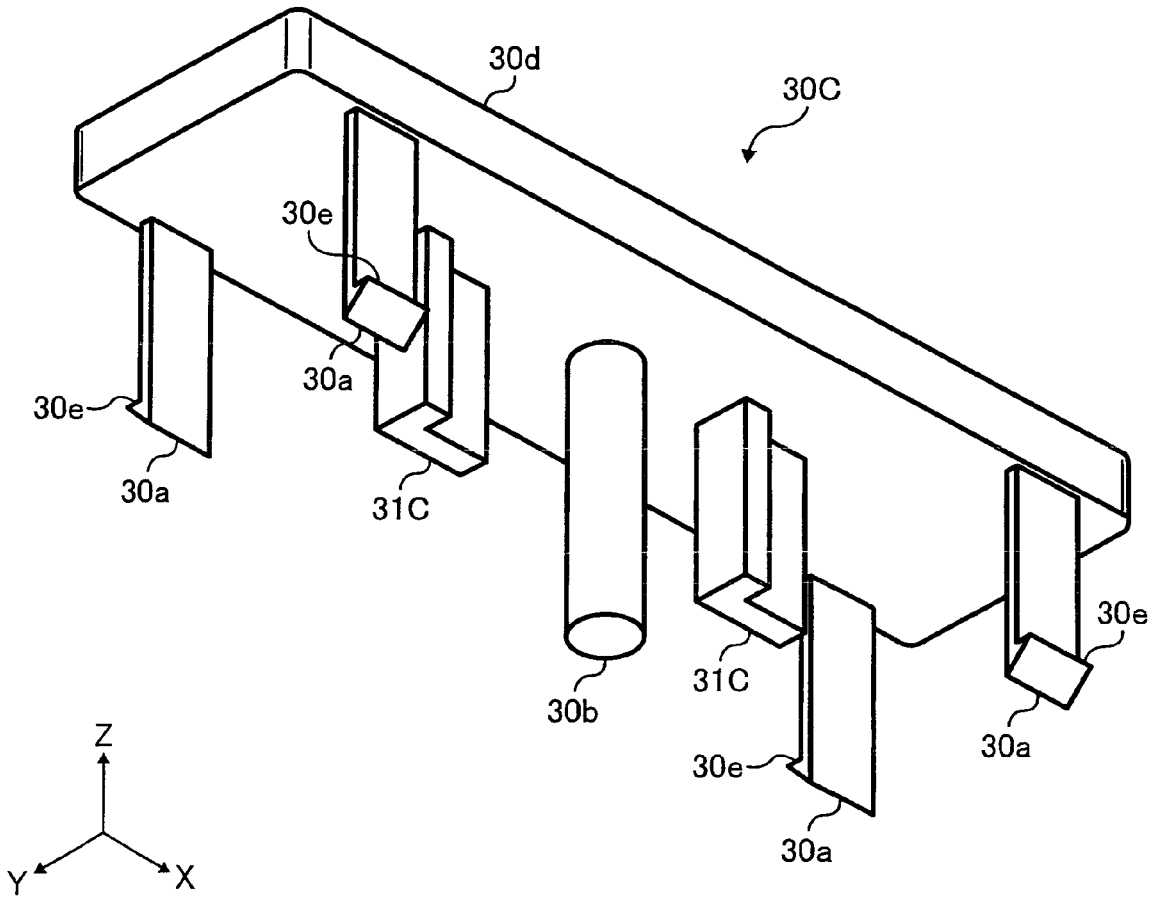
FIG. 7 is a perspective view showing a third key top member engaged with a first depression in FIG. 2.

As shown in FIG. 7, the third key top member 30C includes a push portion 30*d*, four leg portions 30*a*, an actuation portion 30*b*, and a pair of positioning portions 31C.

The push portion 30*d* has a longitudinal direction along the X direction, and is in the shape of a rectangular solid. The four leg portions 30*a* are formed at the four corners on an under surface of the push portion 30*d*. The actuation portion 30*b* is located in the area on the central part of an under surface of the push portion 30*d*. A pair of positioning portions 31C are located along the X direction at both sides of the actuation portion 30*b*.

The third key top member 30C can be formed, for example, by injection molding if it is made of plastic.

Each leg portion 30*a* includes a claw 30*e* turned to the outside of the push portion 30*d*.

A pair of positioning portions 31C are L-shaped in a cross-section, and stick out to the under direction from the under surface of the push portion 30*d*. When the third key top member 30C is attached to the first depression 23C, a pair of positioning portions 31C are inserted to a pair of apertures 24C with a predetermined clearance.

The fourth key top member 30D (see FIG. 3A) and the third key top member 30C are almost the same structure. However, they differ in a direction of a pair of positioning portions, so that each of them can be inserted into corresponding L-shaped apertures.

The fourth key top member 30D includes a push portion 30*d*, four leg portions 30*a*, an actuation portion 30*b*, and a pair of positioning portions. The push portion 30*d* has a longitudinal direction along the X direction, is in the shape of a rectangular solid. The four leg portions 30*a* are formed at the four corners on an under surface of the push portion 30*d*. The actuation portion 30*b* is located in the area on the central part of an under surface of the push portion 30*d*. A pair of positioning portions are located along the X direction at both sides of the actuation portion 30*b*. Each leg portion 30*a* includes a claw 30*e* turned to the outside of the push portion 30*d*. A pair of positioning portions are L-shaped in a cross-section, and stick out to the under direction from the under surface of the push portion 30*d*. When the fourth key top member 30C is attached to the fourth depression 23D (see FIG. 4), a pair of positioning portions are inserted to a pair of apertures 24D with a predetermined clearance.

The fifth key top member 30E (see FIG. 3A) and the second key top member 30B are almost the same structure. However, they differ in a direction of a pair of positioning portions so that each of them can be inserted in corresponding L-shaped apertures.

The fifth key top member 30E includes a push portion 30*d*, four leg portions 30*a*, an actuation portion 30*b*, and a pair of positioning portions. The push portion 30*d* has a longitudinal direction along the X direction, and is the shape of a rectangular solid. The four leg portions 30*a* are formed to the four corners on an under surface of the push portion 30*d*. The actuation portion 30*b* is located in the area on the central part of an under surface of the push portion 30*d*. A pair of positioning portions are located along the X direction at both sides of the actuation portion 30*b*. Each leg portion 30*a* includes a claw 30*b* turned to the outside of the push portion 30*d*. A pair of positioning portions are T-shaped in a cross-section, and stick out to the under direction from the under surface of the push portion 30*d*. When the fifth key top member 30E is attached to the fifth depression 23E (see FIG. 4), a pair of positioning portions are inserted to a pair of apertures 24E with a predetermined clearance.

The sixth key top member 30F (see FIG. 3A) and the first key top member 30A are almost same structure. However, they differ in a direction of a pair of positioning portions so that each of them can be inserted into corresponding L-shaped apertures.

The sixth key top member 30F. includes a push portion 30*d*, four leg portions 30*a*, an actuation portion 30*b*, and a pair of positioning portions. The push portion 30*d* has a longitudinal direction along the X direction, and is in the shape of a rectangular solid. The four leg portions 30*a* are formed to the four corners on an under surface of the push portion 30*d*. The actuation portion 30*b* is located in the area on the central part of an under surface of the push portion 30*d*. A pair of positioning portions are located along the X direction at both sides of the actuation portion 30*b*. Each leg portion 30*a* includes a claw 30*e* turned to the outside of the push portion 30*d*. A pair of positioning portions are L-shaped in a cross-section, and stick out to the under direction from the under surface of the push portion 30*d*. When the fifth key top member 30E is attached to the sixth depression 23F (see FIG. 4), a pair of positioning portions are inserted to a pair of apertures 24F with a predetermined clearance.

Each of the above-mentioned key top members 30A-30F is engaged with each corresponding depression 23A-23F located at an upper surface of the cover 22 from an upper direction. As discussed below using FIG. 8A and FIG. 8B, the first key top member 30A is described as a representative example.

Figure 8A:
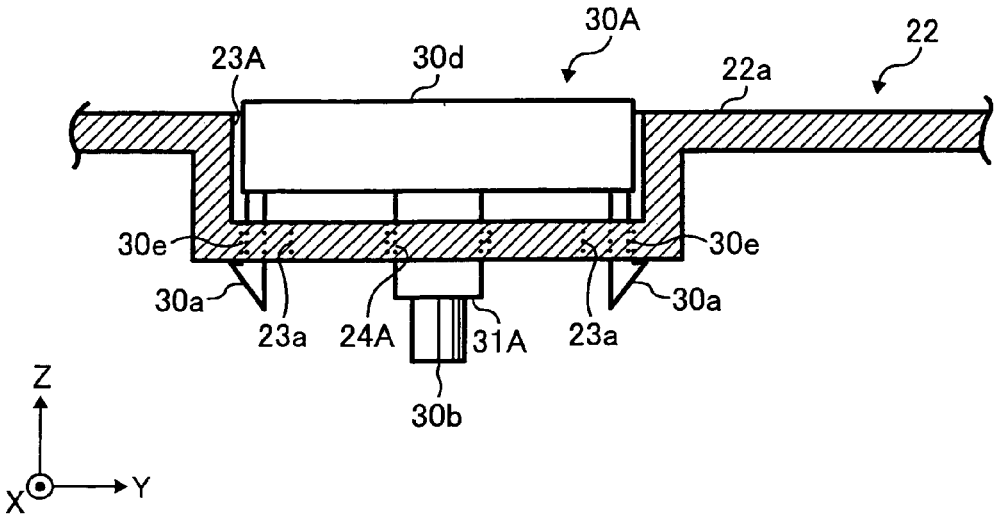
FIG. 8A and FIG. 8B are side elevation view showing a first key top member attached to the first depression.
Figure 8B:
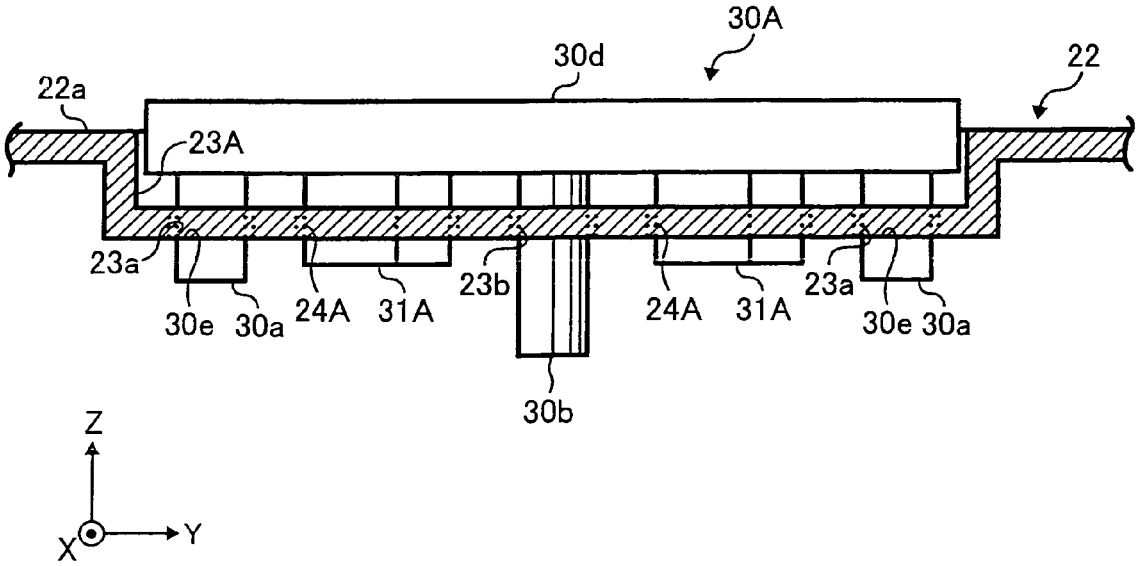

As shown in FIG. 4, FIG. 8A, and FIG. 8B, the first key top member 30A is attached to the first depression 23A from an upper direction, in the state that the top surface of the push portion 30*d* is exposed to. In this case, the four legs 30*a* are inserted onto the four rectangular apertures 23*a*, the actuation portion 30*b* is inserted onto the circular hole 23*b*, and a pair of positioning portion 31A is inserted onto the L-shaped positioning portion. The first key top member slides between a position where the claw is contacted with the under surface of the depression and a position where the under surface of the push portion is contacted with the upper surface of the depression.

Figure 9:
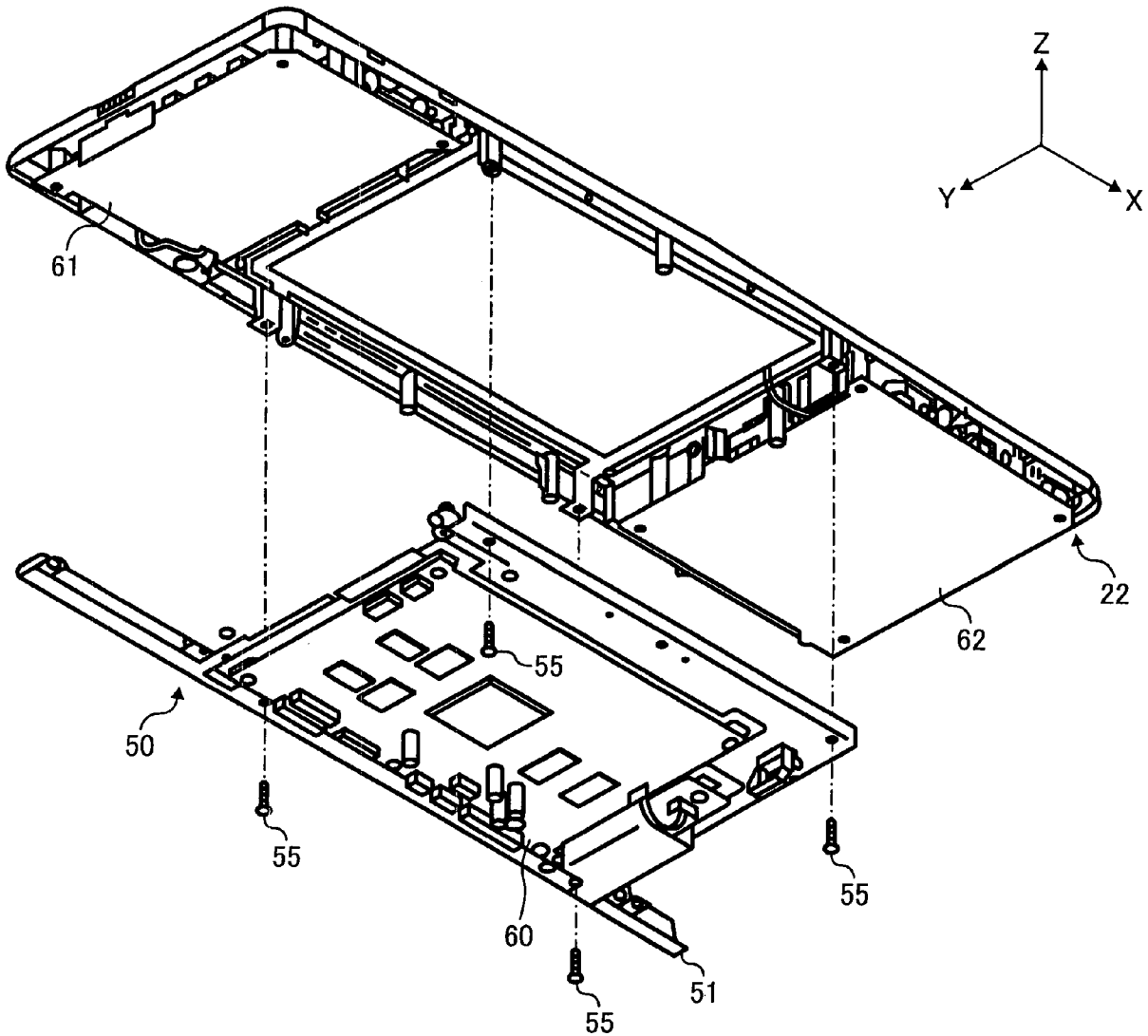
FIG. 9 is a perspective view showing a relation of the cover, boards, and the display unite in the above mentioned embodiment.

As shown in FIG. 9, the board 61 is accommodated in an internal space of the housing (this housing forming a part of an operation panel) corresponding to the first interface part 28, and the board 62 is accommodated in an internal space of the housing corresponding to the second interface part 29.

The board 61 is an approximately square-shaped epoxy board. Plural electronic parts forming a electric circuit are located on both the front and back sides of the board 61. The board 61 is fixed to plural pipe-shaped portions formed on the under surface of the top board 22*a* by bolts.

In an internal space that is formed by using the top board 22*a* of the cover 22 and an upper surface of the board 61, there are elastic members corresponding to each of the key top members 30A-30F that bias each key top member to the Z direction, and switches that correspond to the key top members. Each of the elastic members have a same size and same structure. Each of the switches have a same size and structure. Therefore, in the following description, the elastic member 35 and the switch 64 are described as a representative example.

Figure 10:
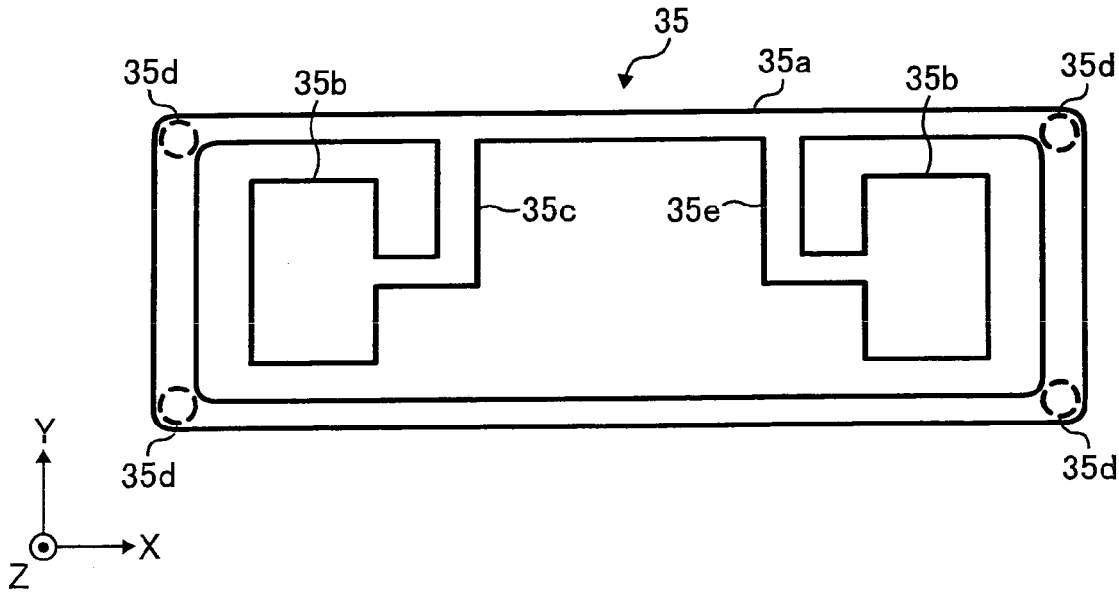
FIG. 10 is a plane view showing an elastic member of a first key top member.

As shown in FIG. 10, the elastic member 35 is located in the first depression 23A. The elastic member 35 can be formed, for example, by injection molding if it is made of plastic. The elastic member 35 includes a pair of moving parts 35*b*, a frame 35*a*, and hinges 35*c* and 35*e*. Each moving part 35*b* is oblong-shaped and has a longitudinal direction along the Y direction. The frame 35*a*, having a longitudinal direction along the Z direction, surrounds a pair of moving parts 35*b* and includes four bar-shaped legs on its four corners. The hinges are L-shaped and connect the moving parts 35*b* to the frame 35*a*. The moving parts 35*b* and the legs 30*a* of the first key top member 30A are in touch so that the moving parts bias the first key top member 30A to an upper direction.

Figure 11A:
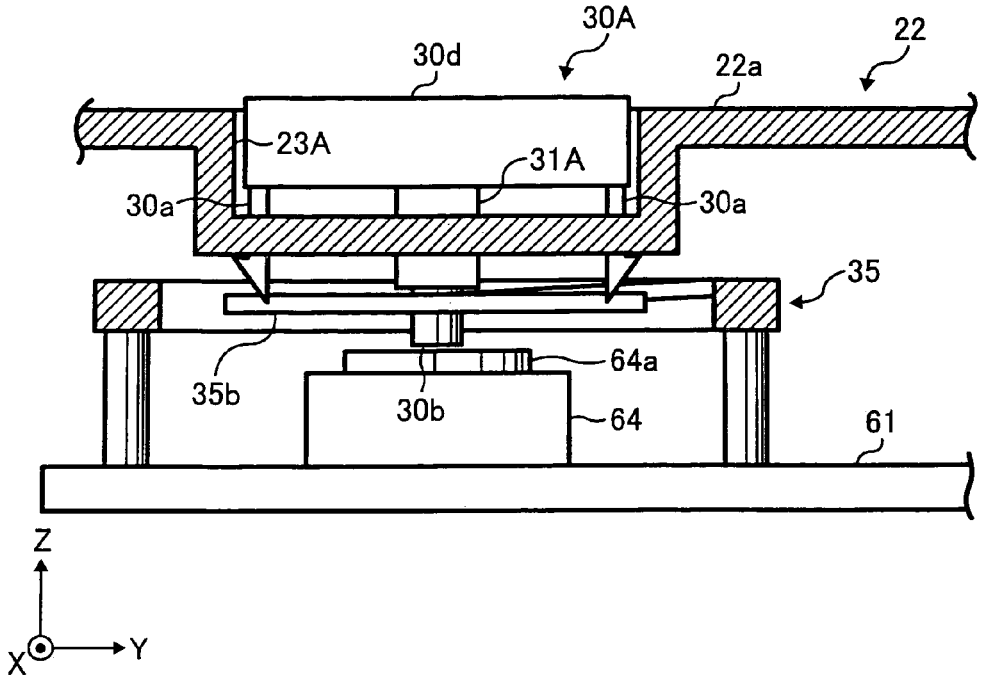
FIG. 11A and FIG. 11B are side elevation views showing a structure of the push button mechanism of the above mentioned embodiment.
Figure 11B:
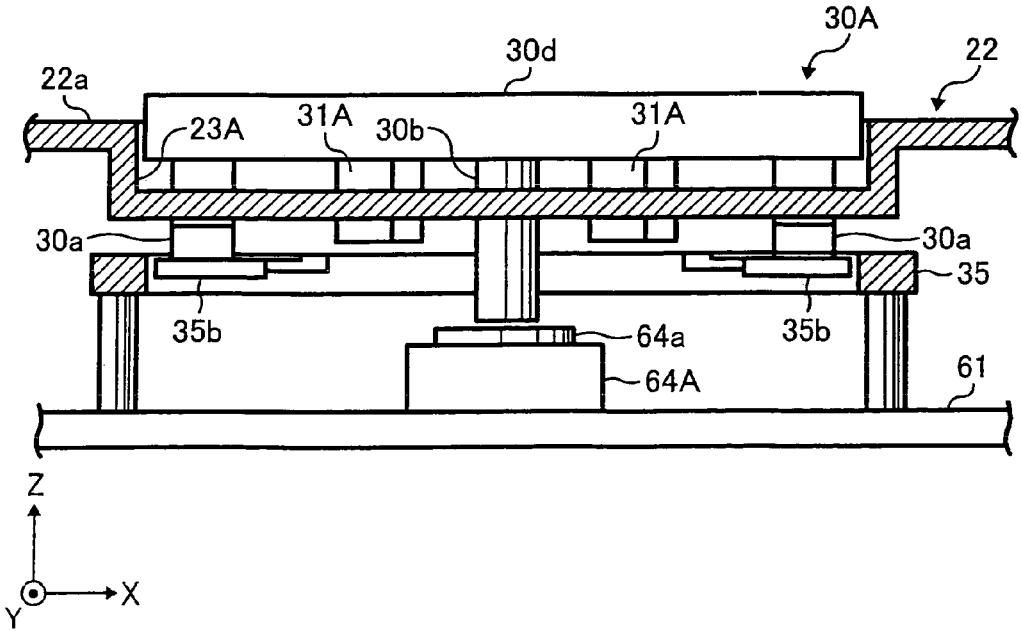

As shown in FIG. 11A and 11B, the switch 64 is fixed on the board 61. The switch 64 has a electrical contact internally. The switch 64 has a slider 64*a* in the shape of a cylinder. The slider 64*a* is always biased to the upper direction (Z direction in FIG. 11A and FIG. 11B) by the biasing mechanism. When the external force acts on the slider 64*a*, the slider 64*a* moves downward and closes the electrical contact (the switch becomes ON status). The switch 64 is located in the upper surface of the board 61 so that a vicinity of the center in the slider 64*a* is located immediately below the actuation portion 30*b*.

As shown in FIG. 9 again, the board 62 is an approximately square-shaped epoxy board. Plural circular-shaped push button switches or indicating lamps are located on the board 62. The board 62 is fixed to the under surface of the top board 22*a* so that the push button switches and the indicating lamps are exposed from apertures formed on a second interface part 29 of the cover 22.

As shown in FIG. 9, display unit 50 includes a holder 51 and a display main body 60 (for example, liquid crystal display) held to the holder 51. The holder 51 has a fixing part comprising a stick member that is S shaped in the YZ section, and an oblong frame that is located at the lower end of the fixing member. The holder 51, for example, is formed by sheet metal processing. The display main body 60 is fixed to the holder 51 by screws. Then the display unit 50, as shown in FIG. 9, is attached to the under surface of the top board 22*a* of the cover 22 by using the screws inserted to bores.

Figure 12A:
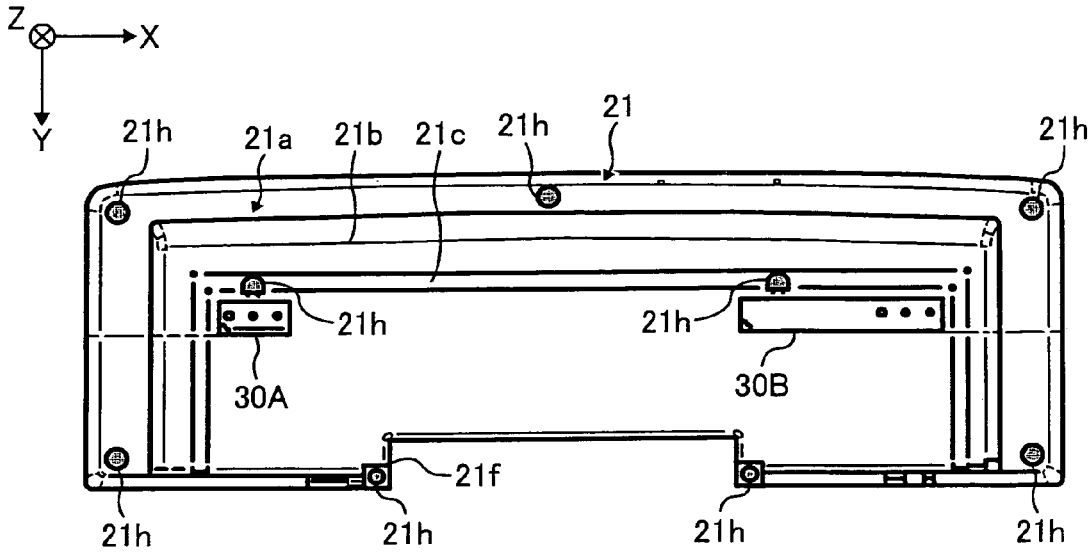
FIG. 12A is a plane view showing a base of the operation panel in FIG. 2.
Figure 12B:
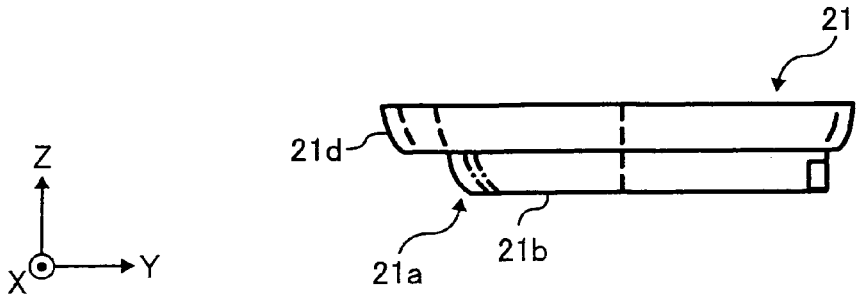
FIG. 12B is a side elevation view showing a base of the operation panel in FIG. 2.

As shown in FIG. 12A and FIG. 12B, the base 21 has a bottom board 21*a* and side wall 21*d*. The bottom board 21*a* is substantially rectangular and has a longitudinal direction along a X axis direction. The side wall 21*d* is formed at a circumference of the bottom board 21*a* having a step. The base 21 is formed, for example, by injection molding if it is made of plastic.

The bottom board 21*a* has an underside 21*b* that is located in the rectangular part, and is convex downward in FIG. 12B. The underside 21*b* has a groove 21*c* that is U-shaped in plane view. The groove 21*c* is located in the edge portion of the underside 21*b*, except the edge of the Y direction.

Along the longitudinal direction of the groove 21*c*, there are two metal plates 30A and 30B fixed by plural bolts. And the bottom board 21*a* has plural depressions 21*h* that are located along the edge. Each of the depressions 21*h* has a circular hole.

In a neighborhood of a central part of the Y-direction end of the base 21, notch 21*f* is formed by cutting out a part from the underside 21*b* to the side wall 21*d* as a rectangle.

Figure 13A:
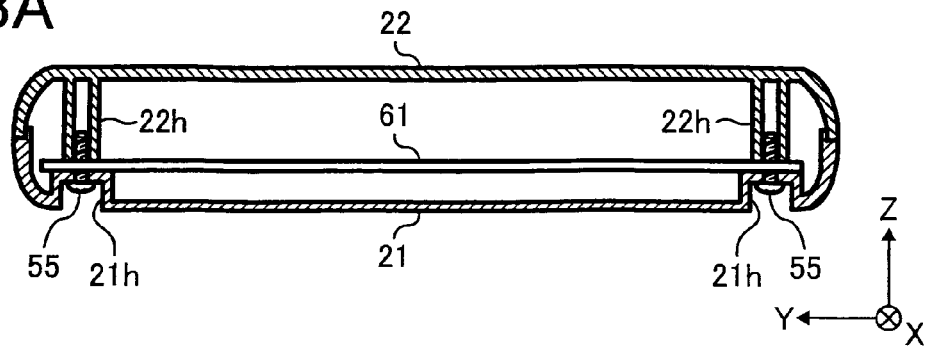
FIG. 13A is a sectional view showing a cross-section view of FIG. 2 along the line A-A.
Figure 13B:
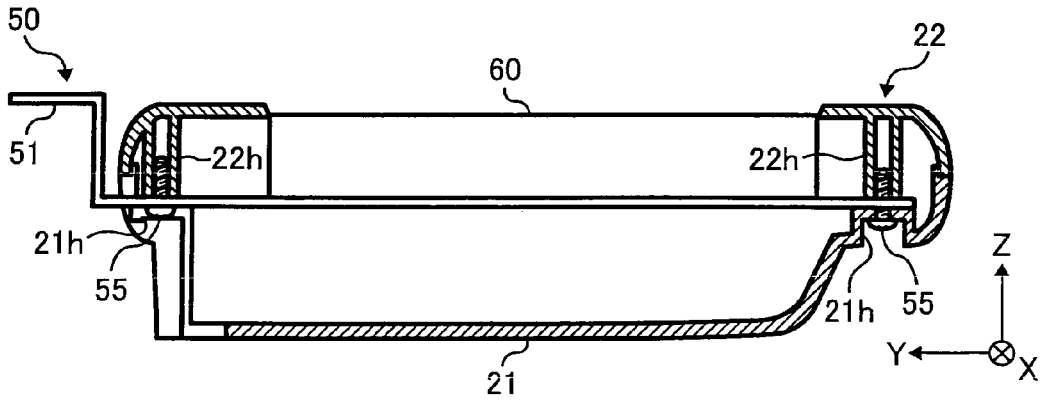
FIG. 13B is a sectional view showing a cross-section view of FIG. 2 along the line B-B.
Figure 13C:
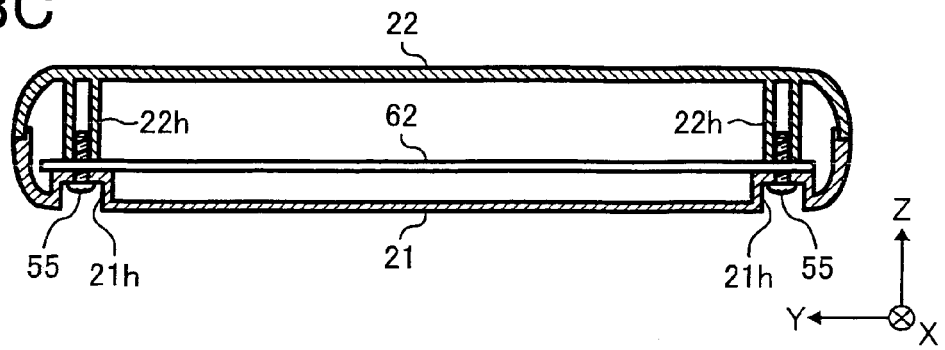
FIG. 13C is a sectional view showing a cross-section view of FIG. 2 along the line C-C.

As shown in FIG. 13A, which is a sectional view along the A-A line of FIG. 2, FIG. 13B, which is a sectional view along the B-B line of FIG. 2, and FIG. 13C, which is a sectional view along the C-C line of FIG. 2, screws 55 are inserted to circular bores that are formed at the depressions 21*h*. Also, the screws 55 arrive to the tube portions formed in the under surface of the top board 16*a* of the cover 22 through the board 61, and the holder 51, or the board 62. In this way, the cover 22 and base 21 are combined. Then the cover 22 and the base 21 are mounted on the main body 10 by bolt by the intermediary of metal plates 30*a* and 30*b*. The electronic circuit in the operation panel 20 and the copier main body 10 are electrically engaged through the notch 21*f*.

As is apparent from the above-mentioned explanation, the push button mechanism of the above-mentioned embodiment includes the key top members 30A-30F, the elastic members 35 biasing the key top members 30A-30F, and the depressions 23A-23F formed in an upper surface of the cover 22.

According to the push button mechanism of the present embodiment, the L-shaped apertures or T-shaped aperture are formed in the depressions 23A-23F in the cover 22 so that each of the apertures facing different directions are located in asymmetric portions against the circular hole 23*b*. Each of the key top members has the L-shaped positioning portions or the T-shaped positioning portions so that each of positioning members facing different directions are located in asymmetric portions against the actuation portion 30*b*. Therefore, each key top member is engaged with the certain depression of the cover 22. For instance, the key top member except the first key top member 30A (having a pair of L-shaped positioning portions) can't be engaged to the first depression 23A (having a pair of L-shaped apertures). By the same token, the key top member except the second key top member 30B (having a pair of T-shaped positioning portions) can't be engaged to the second depression 23B (having a pair of L-shaped apertures).

As for the first key top member 30A and the sixth key top member 30F, the shapes of their positioning portions are the same and their directions are only different by 180 degrees. However, the first key top member can't be attached to the sixth depression such so that a pair of positioning portions are located in asymmetric portions against the circular hole.

Each of key top members 30A-30B is biased by elastic member 35 to the upper direction.

Figure 14:
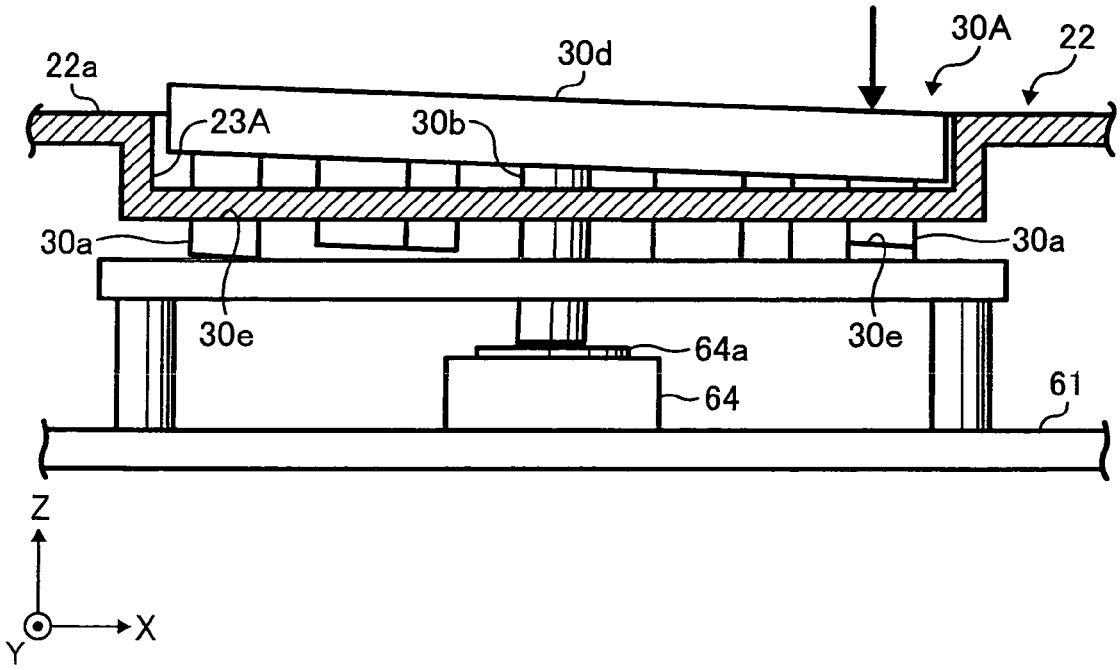
FIG. 14 is a explanatory diagram showing a motion of the push button mechanism of the above mentioned embodiment.

FIG. 14 shows, as an example, a push button mechanism related to the first key top member 30A. When a force (its direction is shown as an arrow in FIG. 14) acts on a position that is out of the center of the push portion, the position where the claw 30*e* of the leg 30*a* contacts with the under surface of the first depression 23A configures the fulcrum of a lever. The push portion 30*d* is swung at the fulcrum as a center of rotation.

The actuation portion 30*b* depresses the slider 64*a* of the switch 64*a* according to the swing of the push portion 30*d*. Then, the actuation portion 30*b* works the electrical contact, hereby.

Therefore, even if the force acts in any place of the push portion 30*d*, the switch 64*a* is operated surely by applying a principle of leverage.

Furthermore, the push button mechanism in the embodiments discussed above, can prevent a wrong engagement to the depression of the cover 22, because the each key top member is engaged with only corresponded depression of the cover 22.

As a result, the operation panel 20 using the push button mechanism discussed above can make for the improvement of the yield ratio and reduce the production cost.

Furthermore, the copier 100 as an image forming apparatus can reduce the production cost because the copier 100 includes the operation panel 20 improved of the yield ratio.

The present invention is not limited to the above-mentioned embodiments.

Although the elastic members 35 in the embodiment discussed above are independently located in the six depressions, the elastic member can have a frame in common between six depressions.

Furthermore, although the each key top member 30A-30F has a pair of positioning portions 31A-31F in the embodiments discussed above, each key top member 30A-30F can have one or more positioning portions, and the positioning portions can have different shapes.

In addition, although six key top members are disposed on the cover 22 in the embodiments discussed above, the cover 22 can have less or more than 6 key top members.

Furthermore, although the push button mechanism including key top members and operation panel 20 are used for the copier 100 in the embodiments discussed above, the push button mechanism and operation panel 20 can be used for an image forming apparatus, for example, a printer, a facsimile, or a multifunction peripheral. The multifunction peripheral has plural functions selected from a copier function, a facsimile function, a printer function, and a scanner function.

As discussed above, the push button mechanism of the present invention is suitable to act as an electrical contact. The operation panel of the present invention is suitable to input an order to an image forming apparatus. Furthermore, the image forming apparatus of the present invention is suitable to form an image according to the order from the operation panel.

Numerous modifications and variations of the present invention are possible in light of the above teachings. It is therefore to be understood that within the scope of the appended claims, the invention may be practiced otherwise than as specifically described herein.

The invention claimed is:

1. A push button mechanism, comprising:

plural push button members having push portions for receiving an external force; and a positioning member having plural positioning portions corresponding to corresponding shapes of said plural push button members, the positioning member configured to prevent engagement of a push button member at a positioning portion that does not correspond to the shape of the push button member, wherein each push button member includes an actuation portion and a pair of discriminative projections, and each pair of discriminative projections has a same shape, which is different from a shape of other pairs of discriminative projections of other push button members.

2. The push button mechanism as defined in claim 1, further comprising:

elastic members corresponding to the plural push button members, the elastic members configured to bias each push button member in an opposite direction to the direction of the external force.

3. The push button mechanism as defined in claim 2, wherein each push button member includes engaging members configured to engage said positioning member.

4. The push button mechanism as defined in claim 3, wherein said engaging members are located in both edges of said push portion so that said engaging members located at one edge become a pivot when the external force acts at a portion that is not a center of the push portion.

5. The push button mechanism as defined in claim 1, wherein said positioning member is a cover forming a part of a housing.

6. An operation panel having the push button mechanism according to claim 5, further comprising:

a base forming the housing with said cover.

7. An image forming apparatus, comprising:

a main body configured to form an image; and the operation panel recited in claim 6.

8. A push button mechanism, comprising:

plural push button members having push portions for receiving an external force; and a positioning member having plural positioning portions corresponding to corresponding shapes of said plural push button members, the positioning member configured to prevent engagement of a push button member at a positioning portion that does not correspond to the shape of the push button member, wherein each push button member has plural discriminative projections; and said positioning member has plural discriminative holes corresponding to the plural projections of each push button member, wherein a shape of the discriminative projections of each push button member is different from a shape of other discriminative projections of other push button members.

9. The push button mechanism as defined in claim 8, further comprising:

elastic members corresponding to the plural push button members, the elastic members configured to bias each push button member in an opposite direction to the direction of the external force.

10. The push button mechanism as defined in claim 9, wherein each push button member includes engaging members configured to engage said positioning member.

11. The push button mechanism as defined in claim 9, wherein said engaging members are located in both edges of said push portion so that said engaging members located at one edge become a pivot when the external force acts at a portion that is not a center of the push portion.

12. A push button mechanism, comprising:

plural push button members having push portions for receiving an external force; and a positioning member having plural positioning portions corresponding to corresponding shapes of said plural push button members, the positioning member configured to prevent engagement of a push button member at a positioning portion that does not correspond to the shape of the push button member, wherein each push button member has a pair of discriminative projections located in asymmetric portions with respect to a center of the push button member; and said positioning member has a pair of discriminative holes corresponding to the pair of projections.

13. The push button mechanism as defined in claim 12, further comprising:

elastic members corresponding to the plural push button members, the elastic members configured to bias each push button member in an opposite direction to the direction of the external force.

14. The push button mechanism as defined in claim 13, wherein each push button member includes engaging members configured to engage said positioning member.

15. The push button mechanism as defined in claim 14, wherein said engaging members are located in both edges of said push portion so that said engaging members located at one edge become a pivot when the external force acts at a portion that is not a center of the push portion.

16. The push button mechanism of claim 12, wherein, for each push button member, a first discriminative projection of the pair of discriminative projections is substantially located a distance L1 from the center of the push button member, while a second discriminative projection of the pair of discriminative projections is substantially located a distance L2 from the center of the push button member, wherein L1 is smaller than L2.

* * * * *